US005396687A

United States Patent [19]

Osterman

[11] Patent Number: 5,396,687

[45] Date of Patent: Mar. 14, 1995

[54] MECHANICAL FASTENER

[76] Inventor: Eric F. Osterman, 5915 S. Cooper St., Seattle, Wash. 98118

[21] Appl. No.: 153,597

[22] Filed: Nov. 12, 1993

[51] Int. Cl.[6] ..... A44B 18/00

[52] U.S. Cl. ..... 24/449; 24/452

[58] Field of Search ..... 24/442, 447, 448, 449, 24/450, 452; 2/912

[56] References Cited

U.S. PATENT DOCUMENTS 3,147,528 9/1964 Erb .
3,266,113 8/1966 Flanagan, Jr. .
4,531,733 7/1985 Hall .
5,077,870 1/1992 Melbye et al. .
5,097,570 3/1992 Gershenson .

*Primary Examiner*—James R. Brittain
*Attorney, Agent, or Firm*—David P. Campbell

[57] ABSTRACT

Fastener elements (10, 12) each include a base (14) and a multiplicity of prongs (16). Each prong (16) includes a head (18) and flange (20) defining an inner stem portion (22) and outer neck portion (24). Heads (18) include inner flat surfaces (25) that abut inner flat surfaces (26) of flanges (20). Two points of engagement are provided along each prong (16) between it and the prongs of a matching fastener element.

12 Claims, 3 Drawing Sheets

MECHANICAL FASTENER

TECHNICAL FIELD

The present invention relates to mechanical fasteners. More particularly, the present invention relates to pressure sensitive, interlocking matching fasteners that provide a strong yet flexible engagement between the two fastener elements.

BACKGROUND OF THE INVENTION

Various types of known mechanical fasteners comprise matching pairs of fasteners that engage and are held to one another over their surface areas. VELCRO fasteners perhaps are the most commonly known of such type fasteners.

U.S. Pat. No. 5,097,570 of Gershenson, issued Mar. 24, 1992, discloses a fastening system comprising matching fasteners, each having a plurality of alternating flexible burrs and burr receiving cavities. The burrs of one fastener interdigitate with the burr cavities of the other fastener when pressed together. The head of the burrs lock into opposing head cavities formed at the base portion of the burrs of a matching fastener.

U.S. Pat. No. 5,077,870 of Melbye, et al., issued Jan. 7, 1992, discloses a mushroom-type hook-and-loop fastener including an array of upstanding stems, each having a mushroom head. The mushroom heads interlock with corresponding mushroom heads of a matching fastener.

U.S. Pat. No. 4,531,733 of Hall, issued Jul. 30, 1985, discloses, in FIGS. 14A, 14B, a mechanical fastener system comprising matching fastener elements, each including a substrate with a plurality of connecting prongs. Each prong includes a tapered head portion and a peripherally extending top locking ridge. A bottom locking ridge is separated from the top locking ridge by an upper recess. A substrate ridge is disposed at the base of each prong just above the substrate. A lower recess separates the substrate ridge from the bottom locking ridge. The dimensions of the prongs are such that adjacent prongs form a cavity corresponding in shape to the prongs of a matching fastener.

U.S. Pat. No. 3,266,113 of W. C. Flanagan, Jr., issued Aug. 16, 1966, discloses in FIGS. 6, 6A, 6B interlocking articles having enlarged heads and a ridge on the stems of the articles. The heads are retained between the ridges and sockets formed in the base or substrate of the articles. The article can be moved with relative ease from shallow to deep engagement by moving the heads past the ridges, but can be disengaged completely from one another only with application of a greater force. Other types of interlocking articles are also disclosed by this patent.

The foregoing discussed patents should be carefully considered in order to put the present invention into proper perspective. An object of the present invention is to provide an improved mechanical fastener that is strong in the sense that it is relatively difficult to separate the interlocking fastener, yet which is relatively flexible in a planar direction to provide some give between the fastener elements.

Disclosure of the Invention

Briefly described, the present invention comprises a fastener element including a base, and a multiplicity of prongs extending substantially normal to the base. Each prong includes an enlarged head at its outer end and a flange spaced along the length of the prong between the enlarged head and the base. The enlarged head and flange of each prong define an inner stem portion and an outer neck portion of the prong. The fastener element is adapted to interlock with a second fastener element in a manner so that each prong of both fastener elements engages the peripheral edge portions of at least two flanges of prongs of the other fastener element. Each flange includes an inner side substantially parallel with the base, and the enlarged head includes an inner side substantially parallel with the base. Upon interlocking of two fastener elements, the inner sides of the enlarged heads of one fastener element engage the inner sides of the flanges of the second fastener element. The spacing between the inner stem portions of adjacent prongs is greater than the diameter of the enlarged heads and the diameter of the flanges. Upon interlocking of two fastener elements, gaps exist between the enlarged heads and the inner stem portions and between the flanges and outer neck portions, providing a flexible interlocking arrangement between the two fastener elements.

Preferably, the spacing between the prongs across the base is such that the spacing between the peripheral edges of the flanges of adjacent prongs is less than the diameter of the enlarged head of a prong. This allows for the peripheral edges of the flanges to engage the peripheral edges of the heads. So arranged, two points of engagement are provided along each prong, each point including matching surfaces aligned substantially parallel with the base.

According to an aspect of the invention, the diameter of the flanges is greater than the diameter of the enlarged heads. Also, the diameter of the inner neck portion of each prong is greater than the diameter of the outer stem portion of each prong. According to another aspect of the invention, the length of the outer neck portion of each prong is greater than the length of the inner stem portion of each prong.

According to another aspect of the invention, the enlarged head of each prong includes along the outer portion of the head an angled surface extending around the periphery of the enlarged head, to facilitate entry of the prongs of one fastener element between the prongs of a second fastener element.

According to another aspect of the invention, the outer neck portions and the inner stem portions taper from their outer ends to their inner ends. This reinforces the prongs and provides a degree of lateral rigidity.

According to another aspect of the invention, the diameters of the inner stem portions are less than the diameters of the enlarged heads.

Preferably, the base of the fastener element is mounted onto a substrate that in turn can be mounted to an object to be attached to the matching fastener element.

Other objects, features, and advantages of the present invention will become apparent from the following description of the best mode and accompanying drawings, and the claims, which are all incorporated herein by reference.

BRIEF DESCRIPTION OF THE DRAWINGS

Like reference numerals refer to like parts throughout the several drawings, wherein.

BEST MODE FOR CARRYING OUT THE INVENTION

Figure 1:
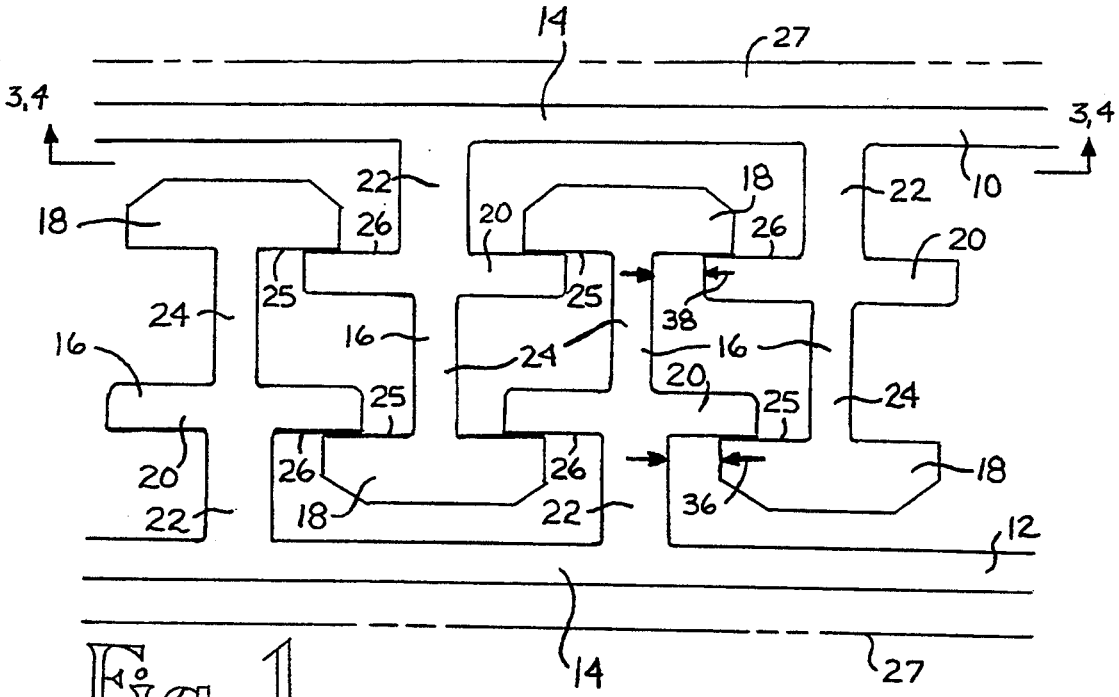
FIG. 1 is a side elevation view of matching interlocking fastener elements of the present invention.

In FIG. 1, a pair of matching fastener elements 10, 12 are shown in an interlocking engagement. Preferably, the fastener elements 10, 12 are identical to each other. However, due to the flexible design of the fasteners, it is possible for there to be some differences between the fasteners.

Figure 2:
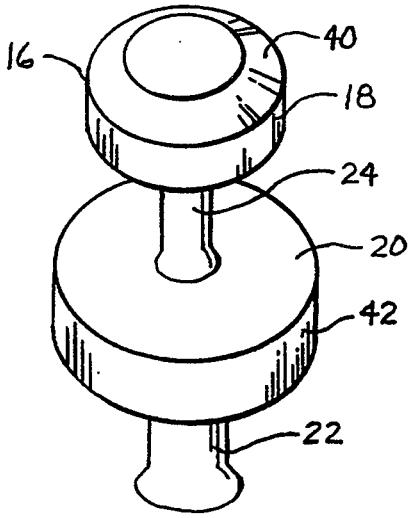
FIG. 2 is an enlarged perspective view of a single prong of the fastener elements shown in FIG. 1.

Each fastener element 10, 12 includes a base 14 and a multiplicity of prongs 16 extending outwardly therefrom. As best shown in FIG. 2, each prong 16 includes an enlarged head 18 and a flange 20. The enlarged head 18 and flange 20 define an inner stem portion 22 and an outer neck portion 24. The base 14 may be attached or mounted onto a substrate 27.

Each head 18 includes a flat inner surface 25. Each flange 20 includes a corresponding flat inner surface 26. Inner surfaces 25, 26 are adapted to abut one another when the fastener elements 10, 12 are interlocked. Inner surfaces 25, 26 provide two levels of engagement along each prong 16 for strengthening the interlocked engagement of the fasteners 10, 12.

As shown in FIG. 1, the inner stem portion 22 has a greater diameter than the outer neck portion 24. However, the diameters of the inner stem portion 22 and outer neck portion 24 could be equal. The neck 24 and stem 22 could also taper outwardly. Also, the diameter of the flanges 16 is greater than the diameter of the heads 18. Again, however, the diameters of the flanges and heads could be equal.

The positioning of the flanges 20 along the stem and neck 22, 24 can be varied within limits. It is necessary that the spacing between flanges 20 and heads 18 and the spacing between flanges 20 and base 14 be sufficient to allow the heads 18 and flanges 20 of an inserted prong of a matching fastener element to flex slightly as the fastener elements are interlocked. This is discussed in more detail later.

The spacing between the prongs 16 of a particular fastener element is such that the distance between the heads 18 of adjacent prongs and the distance between the flanges 20 of adjacent prongs is less than the diameters of the flanges 20 and the heads 18, respectively. As shown, this provides engagement between the inner sides 26 of flanges 20 with the inner sides 25 of heads 18. The inner engaging surfaces 25, 26 of the prongs 16 are flat surfaces that are aligned parallel with the bases 14 of the interlocking fastener elements 10, 12. This provides two levels of engagement along each prong with the prongs of an interlocking fastener element.

The spacing between the prongs 16 of a fastener element also is sufficient so that gaps 36 exist between heads 18 and the inner stem portions 22, and gaps 38 exist between flanges 20 and the outer stem portions 24. Gaps 36, 38 provide a degree of lateral flexibility between the interlocking fastener elements 10, 12. For certain applications, it is desirable that fastener elements 10, 12 be able to move laterally to some degree with respect to each other. The spacing between the prongs can be varied to provide this degree of lateral flexibility.

As best shown in FIG. 2, each enlarged head 18 has a bevelled upper surface 40. The angle of the beveled surface 40 facilitates entry of the prongs past the peripheral edges of heads 18 and flanges 20 of a matching fastener element, as the fastener elements 10, 12 are interlocked together. Alternatively, the upper surface 40 could be rounded. The flange 20 shown in FIG. 2 is a disc-shaped flange With a constant cross-section in the radial direction. However, flange 20 may taper in cross-section from the neck 24 radially outwardly to its peripheral edges 42.

The fastener elements can be made of any flexible, yet resilient material, such as thermoplastic, resins, polymers, or nylon. Any known process for injection molding is sufficient for manufacturing the fastener elements.

Figure 3:
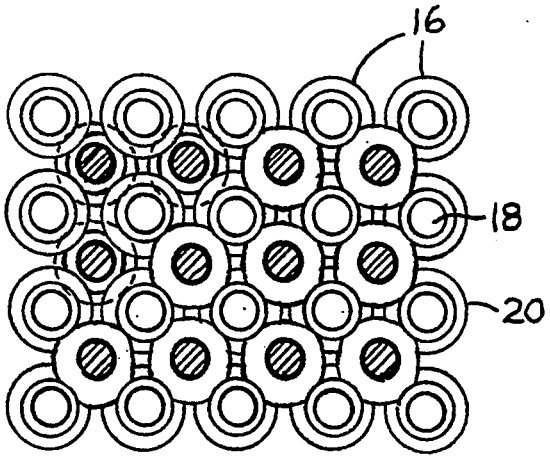
FIG. 3 is a sectional view taken along the line 3—3 of FIG. 1 showing a preferable arrangement for the prongs on the base on the fastener elements of FIG. 1, with a portion of the flanges of one of the fastener elements shown in dashed lines.

FIG. 3 depicts a preferred grid-like or lattice-like arrangement for the prongs. In this arrangement, the prongs are arranged in rows and columns. The prongs of a matching fastener element insert between the prongs in a manner so that four prongs of one fastener element surround a single prong of the other fastener element. In this manner, the peripheral edges of four flanges mate with the peripheral edges of the head of each prong. As a result, eight points of engagement are established for each prong between it and the surrounding prongs of a matching fastener element.

Figure 4:
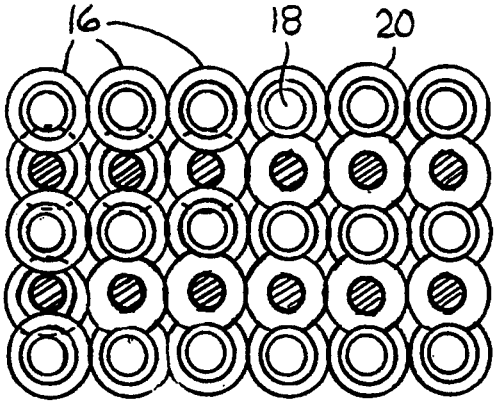
FIG. 4 is a sectional view of an alternative embodiment showing a different arrangement for the prongs of the fastener elements of FIG. 1, with a portion of the flanges of one of the fastener elements shown in dashed lines.

FIG. 4 depicts an alternative arrangement in which the prongs are arranged simply in rows. The rows are spaced apart from each other to accommodate rows of prongs from a matching fastener element. In this manner, the peripheral edges of the each head engage the peripheral edges of two flanges of a matching fastener element. Four points of engagement are established for each prong between it and the surrounding prongs of a matching fastener element. Preferably, the prongs 16 are spaced as shown in FIGS. 3 and 4. However, other arrangements are possible, and the prongs may also be spaced semi-randomly about the base 14.

Figure 5:
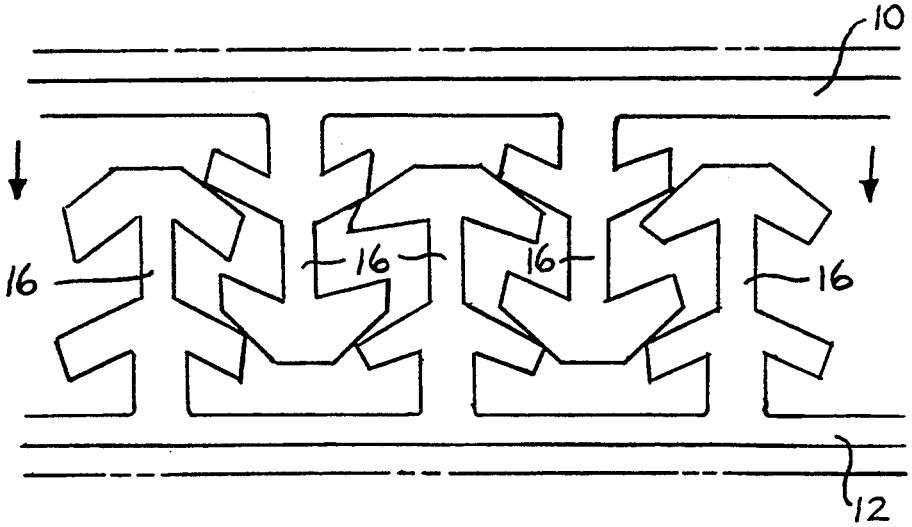
FIG. 5 is a side elevation view illustrating the manner of interlocking the prongs of the fastener elements of FIG. 1.
Figure 6:
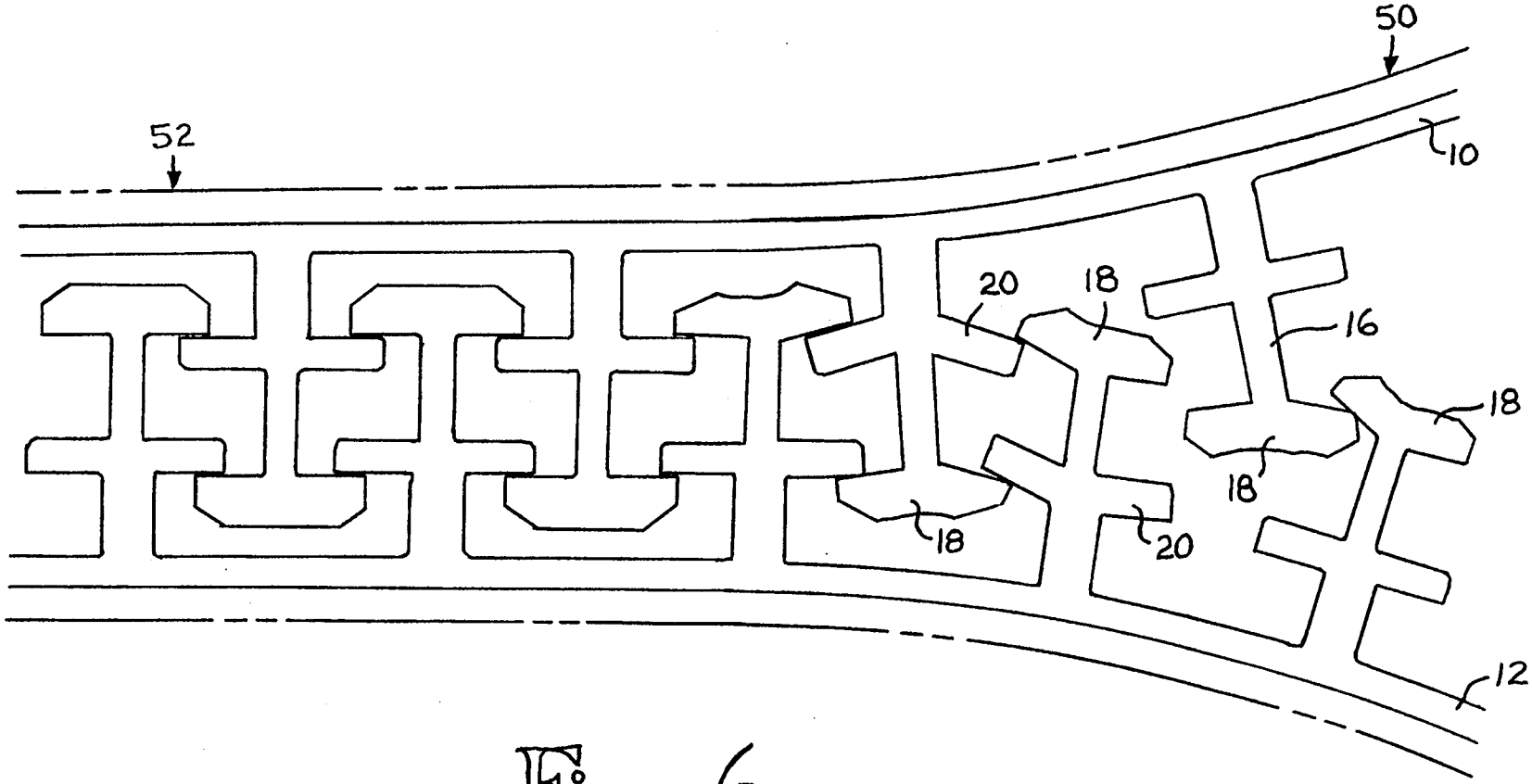
FIG. 6 is a side elevation view showing a method for disengaging the prongs of the fastener elements of FIG. 1.

FIG. 5 depicts a preferred method for interlocking two matching fastener elements 10, 12. As shown, first fastener element 10 confronts second fastener element 12 and is pushed down against fastener element 12 so that the prongs 16 of each fastener move in a parallel manner between each other, with the heads 18 of each prong 16 first moving past the heads 18 on the matching fastener element and then past the flanges 20 of the matching fastener element. FIG. 6 depicts a method for disengaging two fastener elements 10, 12. In this method, the disengaging of the prongs 16 is started at one end 50 of the matching fastener elements 10, 12 and is progressively continued toward the other end 52, as shown. With this method, the prongs 16 move between each other somewhat canted. However, due to the spacing between the prongs 16, sufficient room is provided so that the prongs can be disengaged with minimal difficulty.

The spacing between the prongs 16 when interlocked and when separate from prongs of another fastener element allows the fasteners to be easily cleaned, flushed out, or sterilized better than some prior art fasteners. The edges of the heads 18 and flanges 20 may be rounded or otherwise smoothed. This assists in avoiding snagging or scraping between the fasteners and other objects. Particularly, the smooth surfaces of the prongs avoid scratching or cutting of a person, which is especially advantageous when the fasteners are utilized for clothing.

It is to be understood that many variations in size, shape, and construction can be made to the illustrated and above described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claim or claims interpreted according to accepted doctrines of claim interpretation, including the doctrine of equivalence and reversal of parts.

What is claimed is:

1. A fastener element, comprising:

a base, a multiplicity of prongs extending substantially normal to the base, each prong including an enlarged head at its outer end and a flange spaced along the length of the prong between the enlarged head and the base, the enlarged head and the flange of each prong defining an inner stem portion and an outer neck portion of the prong, the fastener element adapted to interlock with a second fastener element in a manner so that the head of each prong of both fastener elements engages the peripheral edge portions of at least two flanges of prongs of the other fastener element, wherein each flange includes an inner side substantially parallel with the base and the enlarged head includes an inner side substantially parallel with the base, so that upon interlocking of two fastener elements, the inner sides of the enlarged heads of one fastener element engage the inner sides of the flanges of the second fastener element, wherein the spacing between the inner stem portions of adjacent prongs is greater than the diameter of the enlarged heads and the diameter of the flanges, so that upon interlocking of two fastener elements, gaps exist between the enlarged heads and the inner stem portion and between the flanges and outer neck portions, providing a flexible interlocking arrangement between two fastener elements, wherein the length of the outer neck portion of each prong is greater than the length of the inner stem portion of each prong.

2. The fastener element of claim 1, wherein the flanges include an outer side substantially parallel with the base.

3. The fastener element of claim 1, wherein the spacing between the prongs across the base is such that the spacing between the peripheral edges of the flanges of adjacent prongs is less than the diameter of the enlarged head of a prong.

4. The fastener element of claim 1, wherein the diameter of the flanges is greater than the diameter of the enlarged heads.

5. The fastener element of claim 1, wherein the diameter of the inner neck portion of each prong is greater than the diameter of the outer stem portion of each prong.

6. The fastener element of claim 1, wherein the enlarged head of each prong includes along the outer portion of the head an angled surface extending around the periphery of the enlarged head, to facilitate entry of the prongs of one fastener element between the prongs of a second fastener element.

7. The fastener element of claim 1, wherein the outer neck portions and the inner stem portions taper from their outer ends to their inner ends.

8. The fastener element of claim 1, wherein the diameters of the inner stem portion are less than the diameters of the enlarged heads.

9. The fastener element of claim 1, and further comprising a substrate mounted to the base.

10. The fastener element of claim 1, wherein the flange of each prong is spaced along the length of the prong a sufficient distance from the base so that with the flange and an enlarged head of an adjacent prong in engagement, a gap exists between the enlarged head of the adjacent prong and the base.

11. The fastener element of claim 1, wherein the enlarged head of each prong is flat.

12. The fastener element of claim 1, wherein the inner stem portion and outer neck portion of each prong are straight.

* * * * *